US011597477B2

(12) United States Patent
Park et al.

(10) Patent No.: US 11,597,477 B2
(45) Date of Patent: Mar. 7, 2023

(54) MEMBRANE TYPE INSULATION SYSTEM FOR CRYOGENIC LIQUEFIED GAS CARRIER CARGO TANK AND LIQUEFIED GAS FUEL CONTAINER

(71) Applicant: DAEWOO SHIPBUILDING & MARINE ENGINEERING CO., LTD., Geoje-si (KR)

(72) Inventors: Seong Woo Park, Geoje-si (KR); Seung Min Kwon, Incheon (KR); Hyeon Seung Kim, Geoje-si (KR); Joong Kyoo Kang, Geoje-si (KR)

(73) Assignee: Daewoo Shipbuilding & Marine Engineering Co., Ltd., Geoje-si (KR)

( * ) Notice: Subject to any disclaimer, the term of this patent is extended or adjusted under 35 U.S.C. 154(b) by 296 days.

(21) Appl. No.: 16/621,124

(22) PCT Filed: Dec. 27, 2018

(86) PCT No.: PCT/KR2018/016706

§ 371 (c)(1),
(2) Date: Dec. 10, 2019

(87) PCT Pub. No.: WO2019/132531

PCT Pub. Date: Jul. 4, 2019

(65) Prior Publication Data

US 2021/0284290 A1 Sep. 16, 2021

(30) Foreign Application Priority Data

Dec. 27, 2017 (KR) ..... 10-2017-0180711

(51) Int. Cl.
*B63B 25/16* (2006.01)
*B63B 3/68* (2006.01)
(Continued)

(52) U.S. Cl.
CPC ..... *B63B 25/16* (2013.01); *B63B 3/68* (2013.01); *B63B 73/43* (2020.01); *B63B 73/49* (2020.01);
(Continued)

(58) Field of Classification Search
CPC ..... B63B 25/00; B63B 25/16; B63B 3/00; B63B 3/68; B63B 73/43; B63B 73/49;
(Continued)

(56) References Cited

FOREIGN PATENT DOCUMENTS

CN 104981645 A 10/2015
CN 105026819 A 11/2015
(Continued)

OTHER PUBLICATIONS

Office Action of corresponding Korean Patent Application No. 10-2017-0180711—4 pages (dated Jan. 18, 2019).
(Continued)

*Primary Examiner* — Lars A Olson
(74) *Attorney, Agent, or Firm* — Knobbe Marten Olson & Bear LLP

(57) ABSTRACT

In a membrane type heat insulation system for a cryogenic liquefied gas carrier cargo tank and a liquefied gas fuel container, a secondary heat insulation layer comprises a plurality of panels which are stacked in multiple layers while each pair of upper and lower panels is arranged to intersect each other, whereby heat loss which may occur in the gap between the panels can be minimized and deformation due to a temperature difference can be minimized.

8 Claims, 6 Drawing Sheets

(51) Int. Cl.

| | |
|---|---|
| ***F17C 3/06*** | (2006.01) |
| ***F17C 3/02*** | (2006.01) |
| ***B63B 73/43*** | (2020.01) |
| ***B63B 73/40*** | (2020.01) |

(52) U.S. Cl.

CPC ..... *F17C 3/027* (2013.01); *F17C 3/06* (2013.01); *B63B 2221/02* (2013.01); *B63B 2221/08* (2013.01); *B63B 2231/34* (2013.01); *B63B 2231/52* (2013.01); *F17C 2203/035* (2013.01); *F17C 2203/0333* (2013.01); *F17C 2203/0354* (2013.01); *F17C 2203/0358* (2013.01); *F17C 2209/221* (2013.01); *F17C 2209/228* (2013.01); *F17C 2221/033* (2013.01); *F17C 2270/0107* (2013.01)

(58) Field of Classification Search

CPC .... F17C 3/00; F17C 3/027; F17C 3/06; F17C 2203/0333; F17C 2203/035; F17C 2203/0354; F17C 2203/0358; F17C 2209/228; F17C 2221/033; F17C 2270/0107; F17C 2221/02; F17C 2221/08; F17C 2231/34; F17C 2231/52; F17C 2209/221

USPC ..... 220/560.1

See application file for complete search history.

(56) References Cited

FOREIGN PATENT DOCUMENTS

| | | | |
|---|---|---|---|
| CN | 106499946 | A | 3/2017 |
| CN | 106573664 | A | 4/2017 |
| EP | 0214007 | A1 | 3/1987 |
| KR | 10-2012-0015741 | A | 2/2012 |
| KR | 10-2013-0075259 | A | 7/2013 |
| KR | 10-2013-0099906 | A | 9/2013 |
| KR | 10-2017-0050586 | A | 5/2017 |
| KR | 10-2017-0071623 | A | 6/2017 |
| WO | 2014/132661 | A1 | 9/2014 |
| WO | 2016/027460 | A1 | 2/2016 |
| WO | 2017/104988 | A1 | 6/2017 |

OTHER PUBLICATIONS

International Search Report of corresponding PCT Application No. PCT/KR2018/016706—4 pages (dated Apr. 12, 2019).

Extended European Search Report in European Application No. 18896602 dated Sep. 24, 2021 in 7 pages.

First Office Action of Chinese Patent Application No. 201880039181.5—16 pages (dated Mar. 17, 2021).

【FIG. 1】
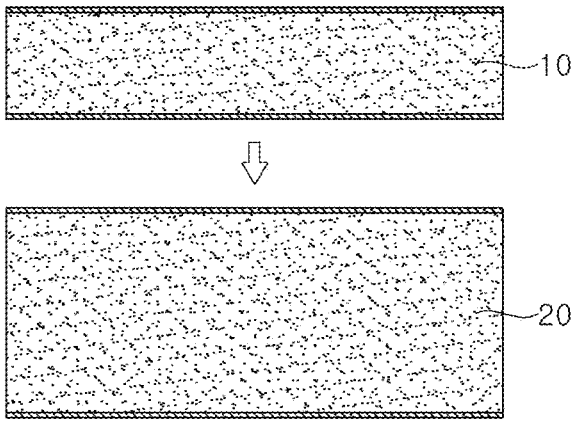
【FIG. 2】
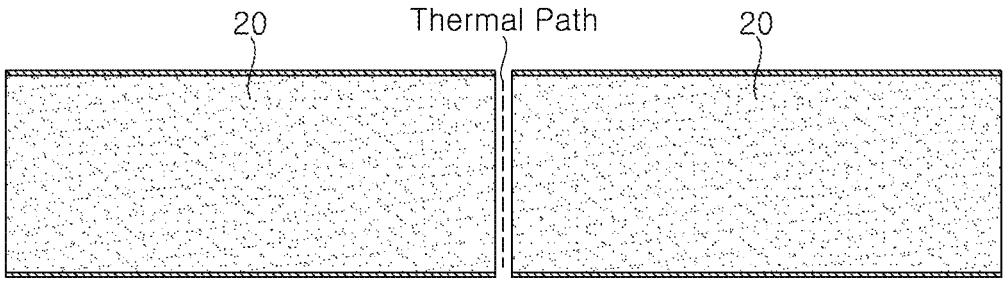
【FIG. 3】
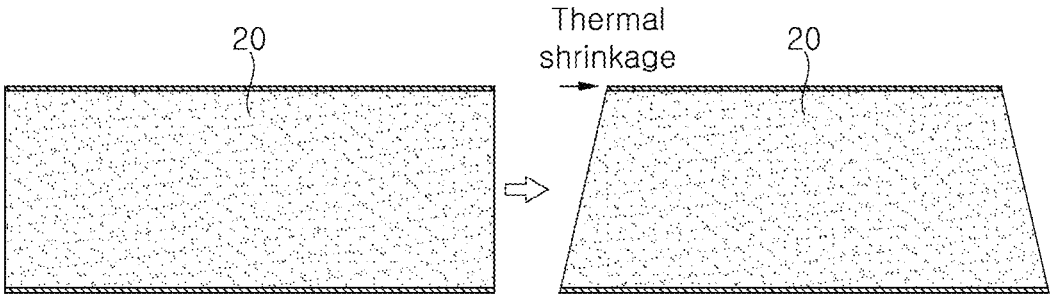

【FIG. 4】
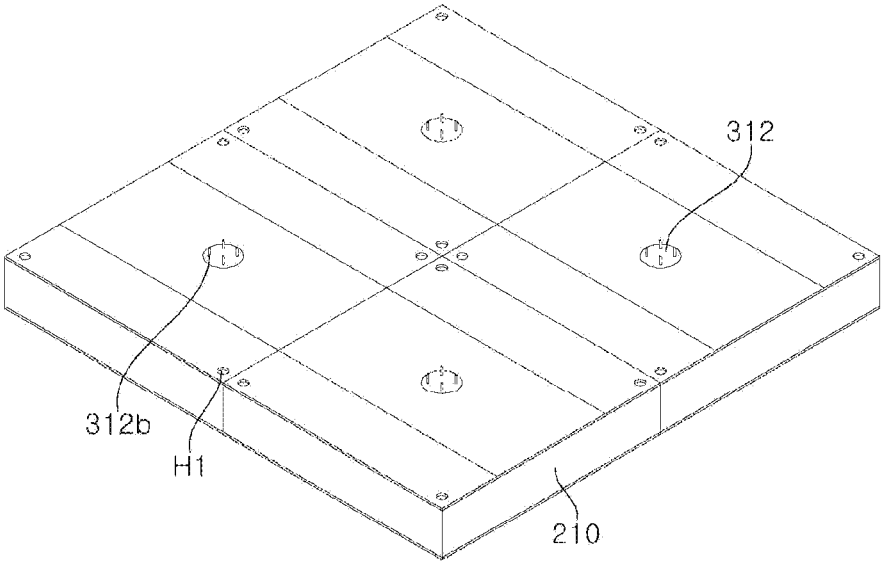
【FIG. 5】
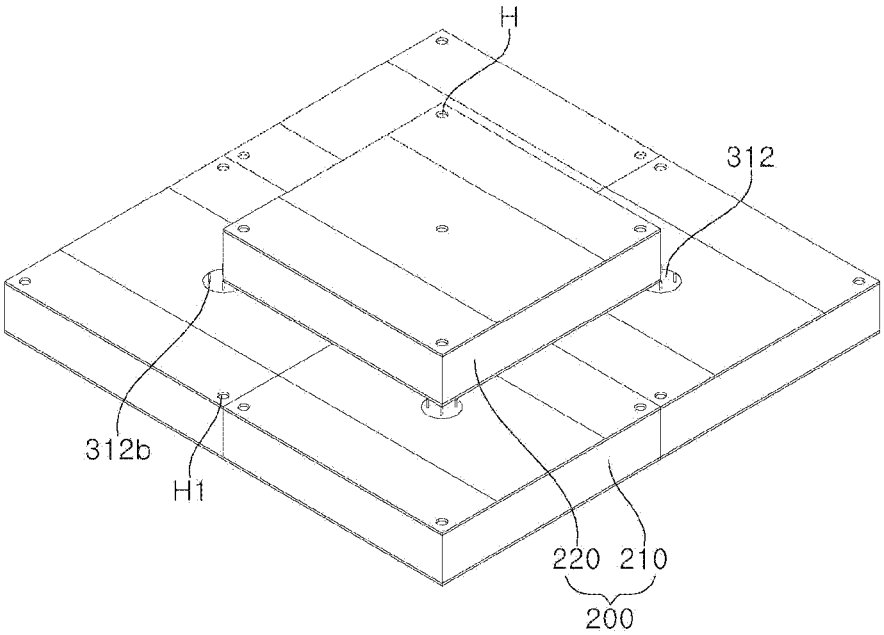

【FIG. 6】
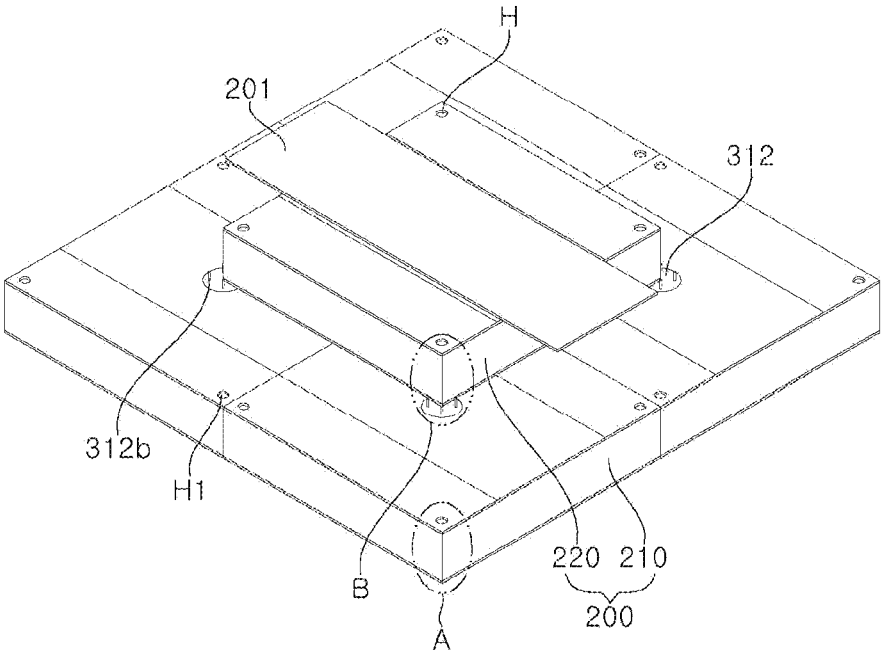
【FIG. 7】
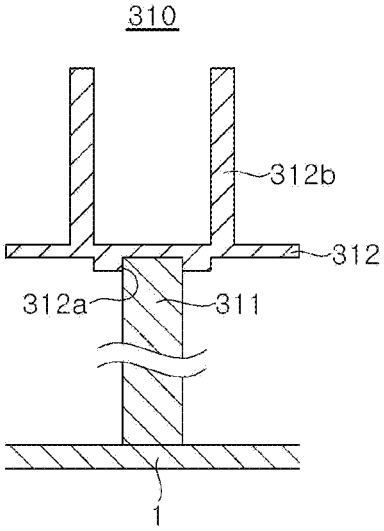

【FIG. 8】
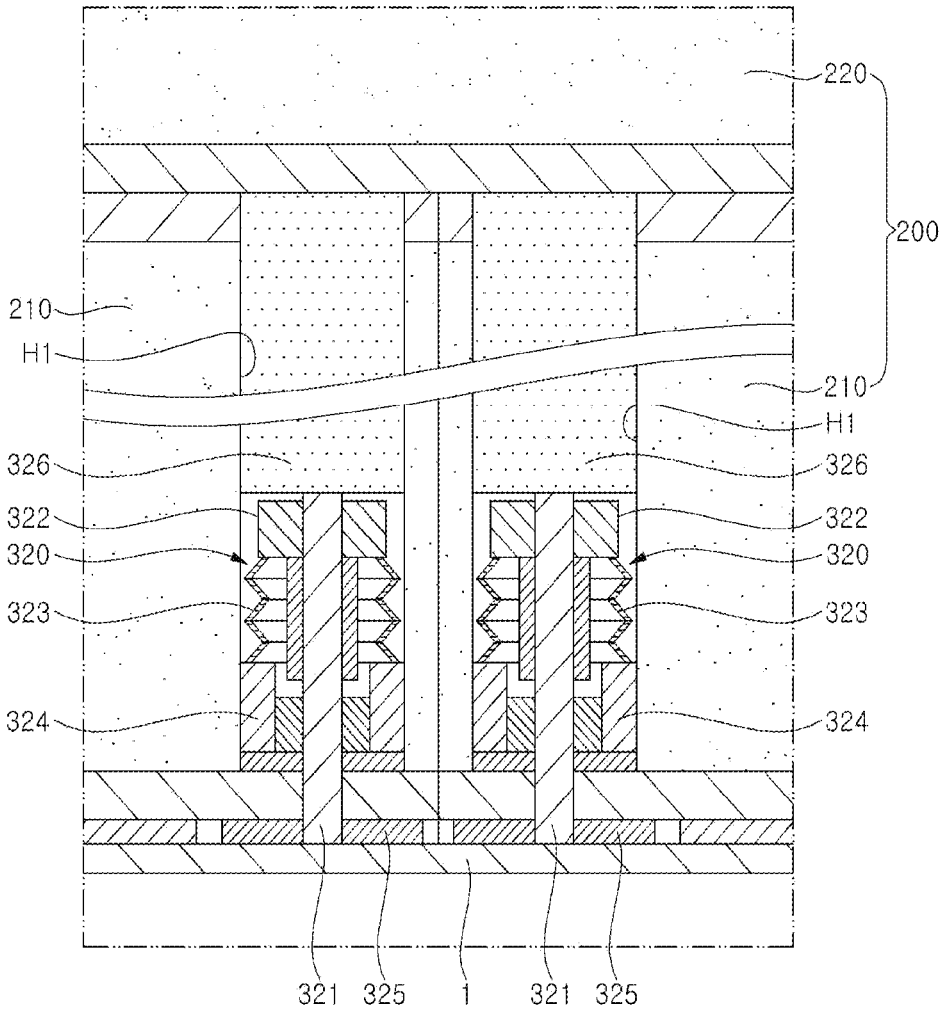

【FIG. 9】
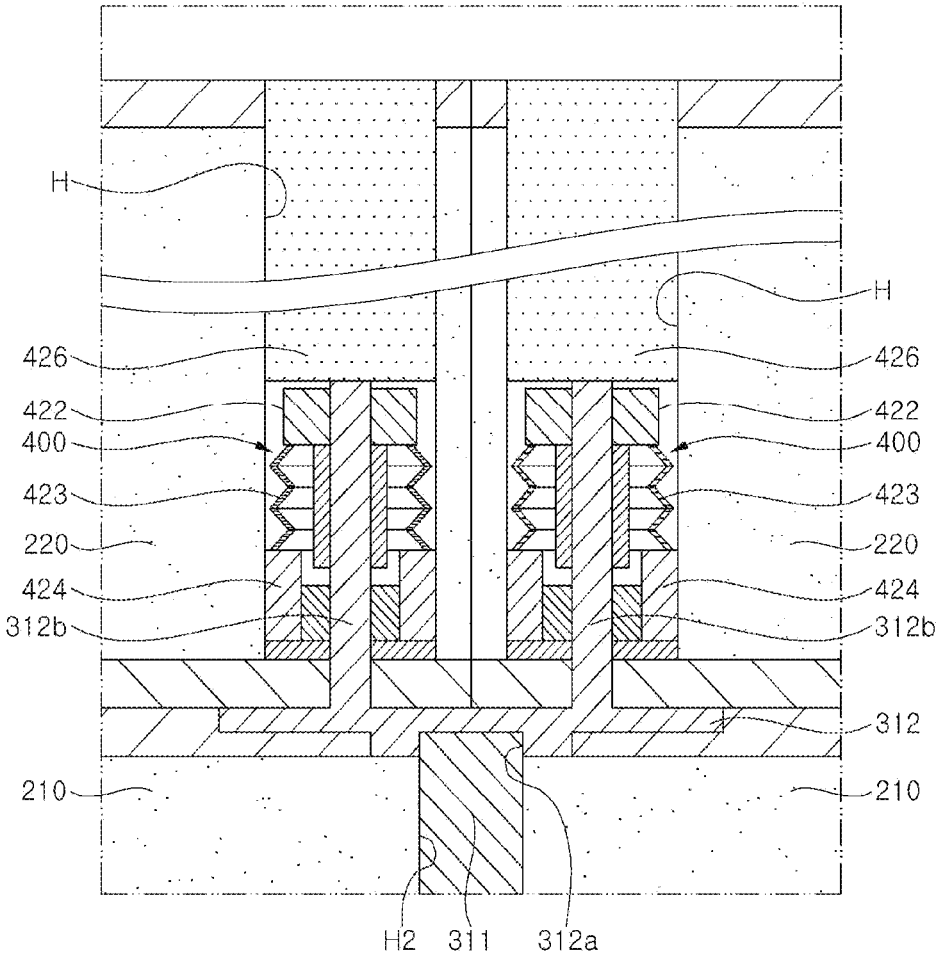
【FIG. 10】
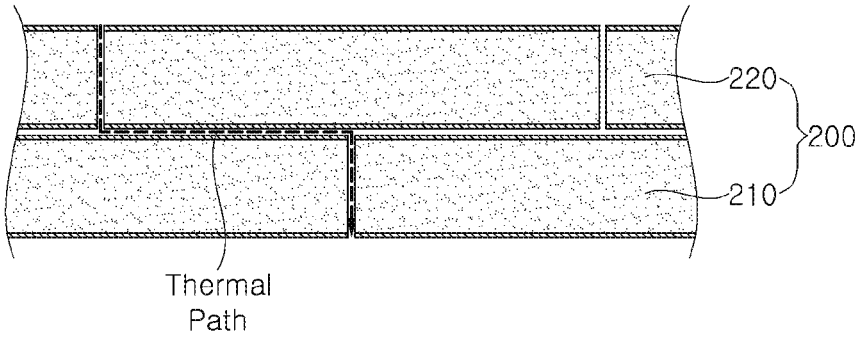

【FIG. 11】
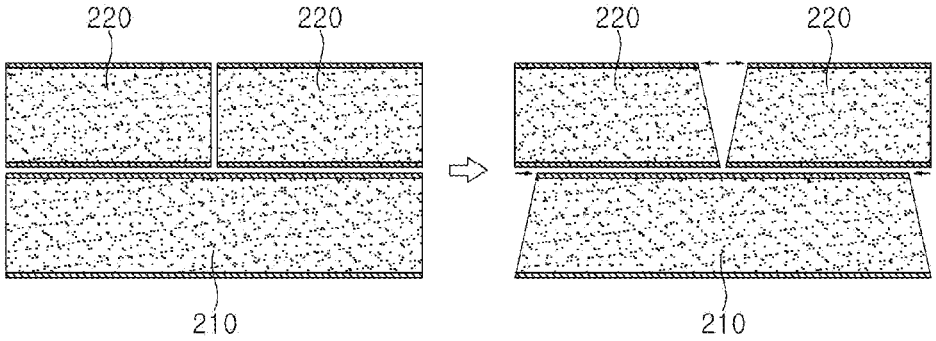
【FIG. 12】
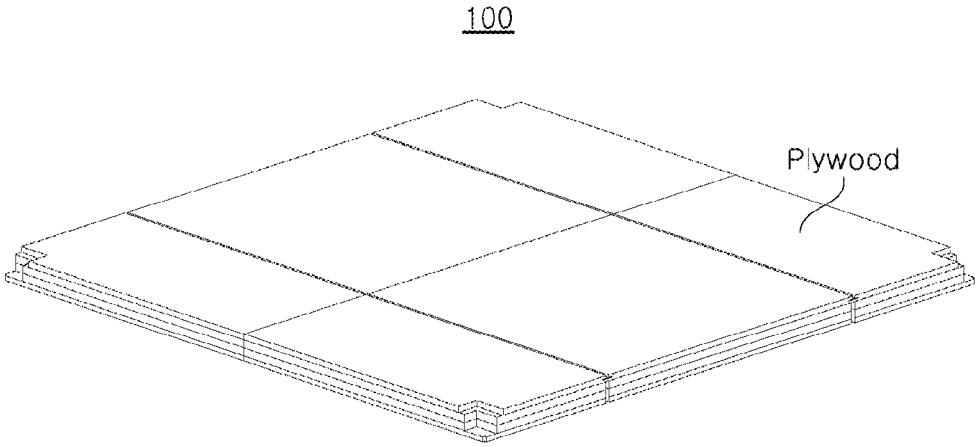
【FIG. 13】
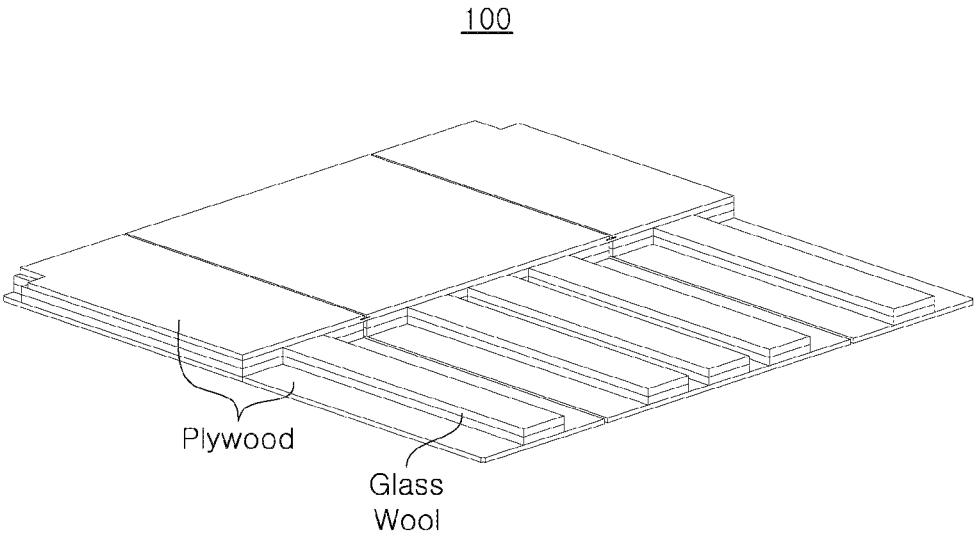

MEMBRANE TYPE INSULATION SYSTEM FOR CRYOGENIC LIQUEFIED GAS CARRIER CARGO TANK AND LIQUEFIED GAS FUEL CONTAINER

TECHNICAL FIELD

The present invention relates to a membrane type insulation system for cryogenic liquefied gas carrier cargo tank and liquefied gas fuel container, and more particularly, to a membrane type insulation system for cryogenic liquefied gas carrier cargo tank and liquefied gas fuel container, in which a secondary insulation layer is composed of a plurality of panels stacked in a multilayer structure for improvement in thermal insulation performance by arranging upper and lower panels to intersect each other in order to minimize heat loss from a gap between the panels and deformation of the panels due to a temperature difference.

BACKGROUND ART

Generally, natural gas is transported in a gaseous state via onshore or offshore gas pipelines, or is transported to a distant destination by an LNG carrier after being liquefied into LNG.

LNG is obtained by cooling natural gas to cryogenic temperatures, for example, about −163° C. and has a volume of about 1/600 that of natural gas in a gaseous state. Thus, LNG is suited to long distance transport by sea.

An LNG carrier, which is designed to carry LNG by sea to an onshore source of demand, or an LNG regasification vessel (LNG RV), which is designed to carry LNG by sea to an onshore source of demand, regasify the LNG, and discharge the regasified LNG to the onshore source of demand, is provided with a storage tank capable of withstanding cryogenic temperatures of LNG, that is, a cargo tank.

Recently, there is increasing demand for floating offshore structures, such as LNG-floating production, storage and offloading (FPSO) or LNG-floating storage and regasification unit (FSRU). Such a floating offshore structure is also provided with a cargo tank that is used in LNG carriers or LNG RV.

An LNG-FPSO is a floating offshore structure that is designed to liquefy produced natural gas, store the liquefied natural gas in a cargo tank, and, if necessary, offload the LNG onto an LNG carrier.

An LNG-FSRU is a floating offshore structure that is designed to store LNG offloaded from an LNG carrier in a cargo tank and, if necessary, regasify the LNG and supply the regasified LNG to an onshore source of demand.

Such an offshore vessel carrying LNG by sea or storing LNG, such as LNG carrier, LNG RV, LNG FPSO, and LNG FSRU, is provided therein with a cargo tank storing LNG in a cryogenic state.

Cargo tanks are classified into an independent type and a membrane type depending upon whether load of a liquid cargo is directly applied to a heat insulator of the cargo tank.

In addition, the membrane type cargo tank is divided into a GTT NO 96-type tank and a TGZ Mark III-type, and the independent cargo tank is divided into an MOSS-type tank and an IHI-SPB-type tank.

The insulation material and structure of the membrane type cargo tank may vary depending upon the type of a special metal sheet that is used as a material for the cargo tank. Specifically, the GTT NO 96-type cargo tank is manufactured using an Invar sheet (an alloy mainly composed of iron and nickel and having a very low coefficient of thermal expansion) and the Mark III-type tank is manufactured using a stainless steel sheet.

The GTT NO 96-type cargo tank has a structure in which primary and secondary membranes formed of an Invar sheet having a thickness of 0.5 mm to 1.5 mm and primary and secondary heat insulation walls formed of a plywood box and perlite are alternately stacked on an inner wall of a hull.

An insulation system of the GTT NO 96-type cargo tank is composed of two layers in which Invar (36% nickel) and insulation boxes formed of perlite and plywood are stacked. Here, plywood is used as a material for the insulation boxes.

A conventional insulation system of a liquefied gas cargo tank has a technical limitation in thickness reduction of a primary insulation layer in order to maintain thermal insulation performance of the primary insulation layer. That is, excessive reduction in thickness of the primary insulation layer can cause problems in terms of thermal insulation performance and settling of the primary insulation layer.

DISCLOSURE

Technical Problem

A liquefied cargo tank includes a plurality of insulation panels formed of polyurethane foam (PUF). Conventionally, since the heat insulation structure formed of polyurethane foam can be insufficient in effective insulation of cryogenic liquefied natural gas, the thickness of the insulation panels is excessively enlarged to improve thermal insulation performance. However, this structure has problems of reduction in loading volume of the cargo tank and increase in manufacturing costs and transportation costs due to increase in thickness and weight of the insulation panels.

Moreover, insulation panels formed of other materials instead of polyurethane foam or Styrofoam typically used in the art has a problem of deterioration in thermal insulation performance or a problem of low strength or impact resistance despite good thermal insulation performance.

FIG. 1 is sectional views of a typical secondary insulation layer and a secondary insulation layer having a thickness-increased monolithic structure. FIG. 2 is a sectional view illustrating heat loss from a gap between the secondary insulation layers having the thickness-increased monolithic structure and FIG. 3 is a sectional view illustrating thermal shrinkage of the secondary insulation layer having the thickness-increased monolithic structure.

Referring to FIG. 1, conventionally, in order to improve thermal insulation performance of the secondary insulation layer 10, a secondary insulation layer 20 of a monolithic structure manufactured just by increasing thickness of a secondary insulation layer 10 is used.

In an insulation system composed of polyurethane foam and plywood constituting the secondary insulation layer, although increase in thickness of the polyurethane foam is required to improve thermal insulation performance, there is a limit to quantitative increase in thickness of the polyurethane foam.

As shown in FIG. 2, a panel having an increased thickness has a reduced thermal path under conditions of actual temperature, thereby causing heat loss, such as convection and the like. In addition, as shown in FIG. 3, there is a problem of significant deformation of the secondary insulation layer of the monolithic structure upon thermal shrinkage.

According to the present invention, in order to solve such problems, metal membranes capable of being used under cryogenic conditions are used as primary and secondary membranes, and a primary insulation layer has a composite structure of plywood, a heat insulator and a composite material to have a thickness set to 20% to 30% of the thickness of a secondary insulation layer, which has a sandwich structure of glass fiber-reinforced polyurethane foam and plywood. In addition, in order to improve thermal insulation performance of an insulation system according to the present invention through increase in thickness of the secondary insulation layer, the secondary insulation layer is formed by stacking a plurality of panels in a thickness direction such that upper and lower panels are arranged to intersect each other in order to minimize heat loss from a gap between the panels and deformation of the panels due to a temperature difference between the panels, instead of using a conventional method of increasing the thickness of the polyurethane foam constituting the secondary insulation layer.

Technical Solution

In accordance with one aspect of the present invention, there is provided an insulation system including a secondary insulation layer disposed on an inner wall of a hull and a primary insulation layer disposed at a liquefied gas side, wherein the secondary insulation layer includes a plurality of panels separately stacked in a multilayer structure in a thickness direction of the secondary insulation layer such that upper and lower panels are arranged to intersect each other.

The insulation system may further include a panel securing unit securing the plurality of panels, and the panel securing unit may include a lower panel securing portion and an upper panel securing portion.

The lower panel securing portion may include: a lower panel securing portion for center securing disposed at a center of a lower panel; and a lower panel securing portion for corner securing disposed near four corners of the lower panel.

The lower panel securing portion for center securing may include: a securing rod welded to the inner wall of the hull and disposed to pass through a securing hole (through-hole) formed at the center of the lower panel; and a securing base having a screw portion formed at a lower portion thereof to be coupled to an upper end of the securing rod and provided with upper panel securing stud bolts to be coupled to four corners of the upper panel.

The lower panel securing portion for corner securing may include: a lower panel securing stud bolt secured to the inner wall of the hull on which the lower panel is disposed; a nut fastened to the lower panel securing stud bolt to secure the lower panel; a washer spring fitted into the lower panel securing stud bolt and allowing resilience regulation depending upon a degree of deformation of the inner wall of the hull; a compression securing mold fitted into the lower panel securing stud bolt and stacked under the washer spring to prevent local damage to the lower panel; and a reference wedge allowing height adjustment thereof depending upon a degree of deformation of the inner wall of the hull.

The upper panel securing portion may include: a nut fastened to each of the upper panel securing stud bolts to secure the upper panel; a washer spring fitted into each of the upper panel securing stud bolts and allowing resilience regulation; and a compression securing mold fitted into each of the upper panel securing stud bolts and stacked under the washer spring to prevent local damage to the upper panel.

The primary insulation layer may have a composite structure of plywood, a heat insulator and a composite material to have a thickness set to 20% to 30% of a thickness of a secondary insulation layer.

The secondary insulation layer may have a sandwich structure of glass fiber-reinforced polyurethane foam and plywood.

Advantageous Effects

As described above, although a conventional technique suggests increase in thickness of a single panel for improvement in thermal insulation, there is a limit in thickness of the panel. That is, the conventional technique has a limit to increase in thickness of the panel due to a limit to foaming height of polyurethane foam. However, the insulation system according to the present invention employs a multilayer stack of plural panels, thereby overcoming the limit to increase in thickness of the panel.

Typically, increase in thickness of the single panel for improvement in thermal insulation can cause thermal shrinkage due to a temperature difference caused by liquefied gas between upper part and lower part in panels of a secondary insulation layer. Here, since the upper panel disposed closer to the liquefied gas than the lower panel suffers from more thermal shrinkage than the lower panel, increase in insulation thickness results in further increase in thermal shrinkage of the panels to generate a gap therebetween, thereby causing deterioration in heat insulation performance.

In order to solve such a problem, according to the present invention, since plural panels disposed to intersect each other have a sandwich structure in which the plywood or the composite material on the surface of the panel undergoes less thermal shrinkage than polyurethane foam, the plural panels undergo smaller shrinkage than a single panel, and intersectional arrangement of the upper panel and the lower panel can suppress generation of a gap between the panels while substantially suppressing heat loss by preventing heat loss from the gap between the upper panels from affecting heat loss from a gap between the lower panels of the secondary insulation layer.

In addition, since the upper panel on the lower panel presses the lower panel in a downward direction and suppresses deformation of the lower panel, deformation of the secondary insulation layer can be minimized, thereby significantly reducing stress applied to a secondary membrane due to deformation of the secondary insulation layer.

DESCRIPTION OF DRAWINGS

FIG. 1 is sectional views of a typical secondary insulation layer and a secondary insulation layer having a thickness-increased monolithic structure.

FIG. 2 is a sectional view illustrating heat loss from a gap between the secondary insulation layers having the thickness-increased monolithic structure.

FIG. 3 is a sectional view illustrating thermal shrinkage of the secondary insulation layer having the thickness-increased monolithic structure.

FIG. 4 is a perspective view of a lower panel of a secondary insulation layer in a membrane type insulation system for cryogenic liquefied gas carrier cargo tank and liquefied gas fuel container according to the present invention.

FIG. 5 is a perspective view of upper and lower panels of the secondary insulation layer in the membrane type insulation system for cryogenic liquefied gas carrier cargo tank and liquefied gas fuel container according to the present invention.

FIG. 6 is a perspective view of the upper and lower panels and a secondary membrane of the secondary insulation layer in the membrane type insulation system for cryogenic liquefied gas carrier cargo tank and liquefied gas fuel container according to the present invention.

FIG. 7 is a sectional view of a lower panel securing portion for center securing in the membrane type insulation system for cryogenic liquefied gas carrier cargo tank and liquefied gas fuel container according to the present invention.

FIG. 8 is a sectional view of the lower panel securing portion for corner securing indicated by Part A of FIG. 6.

FIG. 9 is a sectional view of the upper panel securing portion indicated by Part B of FIG. 6.

FIG. 10 is a sectional view illustrating prevention of heat loss from a gap between panels according to the present invention.

FIG. 11 is a sectional view illustrating thermal shrinkage of panels according to the present invention.

FIG. 12 is a perspective view of a primary insulation layer composed of plywood according to the present invention.

FIG. 13 is a perspective view of a primary insulation layer composed of a composite material according to the present invention.

BEST MODE

Hereinafter, embodiments of the present invention will be described in detail with reference to the accompanying drawings.

FIG. 4 is a perspective view of a lower panel of a secondary insulation layer in a membrane type insulation system for cryogenic liquefied gas carrier cargo tank and liquefied gas fuel container according to the present invention.

FIG. 5 is a perspective view of upper and lower panels of the secondary insulation layer in the membrane type insulation system for cryogenic liquefied gas carrier cargo tank and liquefied gas fuel container according to the present invention.

FIG. 6 is a perspective view of the upper and lower panels and a secondary membrane of the secondary insulation layer in the membrane type insulation system for cryogenic liquefied gas carrier cargo tank and liquefied gas fuel container according to the present invention.

FIG. 7 is a sectional view of a lower panel securing portion for center securing in the membrane type insulation system for cryogenic liquefied gas carrier cargo tank and liquefied gas fuel container according to the present invention, FIG. 8 is a sectional view of the lower panel securing portion for corner securing indicated by Part A of FIG. 6 and FIG. 9 is a sectional view of the upper panel securing portion indicated by Part B of FIG. 6.

Referring to these drawings, the membrane type insulation system for cryogenic liquefied gas carrier cargo tank and liquefied gas fuel container according to the present invention includes a secondary insulation layer 200 disposed on an inner wall 1 of a hull and a primary insulation layer 100 disposed at a liquefied gas side, wherein the secondary insulation layer 200 includes a plurality of panels stacked in a multilayer structure in a thickness direction thereof such that upper and lower panels are arranged to intersect each other.

Specifically, according to the present invention, the secondary insulation layer 200 includes a plurality of panels 210, 220 separately stacked in the multilayer structure in the thickness direction such that upper and lower panels 210, 220 are arranged to intersect each other, thereby minimizing heat loss from a gap between the panels 210, 220 while suppressing deformation of the panels due to a temperature difference therebetween.

In this embodiment, the secondary insulation layer 200 will be illustrated by way of example as being composed of a bilayer structure, that is, a lower panel 210 and an upper panel 220 for convenience of description.

In this embodiment, the panels 120, 220 constituting the secondary insulation layer 200 may have a sandwich structure of glass fiber-reinforced polyurethane foam (R-PUF) and plywood.

According to this embodiment, the membrane type insulation system may further include a panel securing unit adapted to secure the lower panel 210 and the upper panel 220.

The panel securing unit includes a lower panel securing portion adapted to secure the lower panel 210 to the inner wall 1 of the hull, and an upper panel securing portion 400 adapted to secure the upper panel 220.

The lower panel securing portion includes a lower panel securing portion for center securing 310 disposed at a center of the lower panel 210 and a lower panel securing portion for corner securing 320 disposed near four corners of the lower panel 210.

First, referring to FIG. 7, the lower panel securing portion for center securing 310 includes: a securing rod 311 welded to the inner wall 1 of the hull and disposed to pass through a securing hole (through-hole) H2 formed at the center of the lower panel 210; and a securing base 312 having a screw portion 312*a* formed at a lower portion thereof to be coupled to an upper end of the securing rod 311 and provided with four upper panel securing stud bolts 312*b* to be coupled to four corners of the upper panel 220.

In addition, referring to FIG. 8, the lower panel securing portion for corner securing 320 includes: a lower panel securing stud bolt 321 secured to the inner wall 1 of the hull on which the lower panel 210 is disposed; a nut 322 fastened to the lower panel securing stud bolt 321 to secure the lower panel 210; a washer spring 323 fitted into the lower panel securing stud bolt 321 and allowing resilience regulation depending upon a degree of deformation of the inner wall 1 of the hull; a compression securing mold 324 fitted into the lower panel securing stud bolt 321 and stacked under the washer spring 323 to prevent local damage to the lower panel 210; and a reference wedge 325 configured to allow height adjustment thereof depending upon the degree of deformation of the inner wall 1 of the hull.

That is, according to this embodiment, the membrane type insulation system may be secured with different degrees of resilience depending upon deformation conditions of the inner wall 1 of the hull of the cargo tank, and may include the stud bolts 321, the nut 322, the washer spring 323, the compression securing mold 324, and the reference wedge 325.

The lower panel securing stud bolt 321 is secured to the inner wall 1 of the hull on which the lower panel 210 is disposed. The lower panel securing stud bolt 321 may be secured thereto by typical fastening means, for example, welding and the like.

The nut 322 is fastened to the lower panel securing stud bolt 321 to secure the lower panel 210.

The washer spring 323 is fitted into the lower panel securing stud bolt 321 and is configured to allow resilience regulation depending upon a degree of deformation of the lower panel 210 on the inner wall 1 of the hull. For resilience regulation, the washer spring 323 may be replaced by a three-stage type or a five-stage type.

The compression securing mold 324 is fitted into the lower panel securing stud bolt 321 and is stacked under the washer spring 323 to prevent local damage to the lower panel 210 and may be formed of high density PUF, compressed wood, or the like.

The reference wedge 325 is secured to the inner wall 1 of the hull and the stud bolt 321 is secured perpendicularly to the reference wedge 325. The reference wedge 325 is configured to allow height regulation depending upon the degree of deformation of the lower panel 210 on the inner wall 1 of the hull.

A filling plug 326 may be provided to the remaining space of the securing hole (through-hole) H2 formed at the center of the lower panel 210 to prevent damage to the lower panel 210.

Referring to FIG. 9, the upper panel securing portion 400 includes: a nut 422 fastened to each of the upper panel securing stud bolts 312*b* to secure the upper panel 220; a washer spring 423 fitted into each of the upper panel securing stud bolts 312*b* and allowing resilience regulation; and a compression securing mold 424 fitted into each of the upper panel securing stud bolts 312*b* and stacked under the washer spring 423 to prevent local damage to the upper panel 220.

A filling plug 426 may be provided to the remaining space of each of securing holes (through-hole) H formed at the corners of the upper panel 220 to prevent damage to the upper panel 220.

Next, installation of the secondary insulation layer 200 and the primary insulation layer 100 will be described with reference to the accompanying drawings (see FIG. 12). First, the lower panel 210 is primarily secured on the inner wall 1 of the hull using the lower panel securing portion for corner securing 320 and is additionally secured thereto using the lower panel securing portion for center securing 310.

Primary securing of the lower panel 210 on the inner wall 1 of the hull using the lower panel securing portion for corner securing 320 may be realized by fastening the nut 322 to the lower panel securing stud bolt 321 welded to the inner wall 1 of the hull, with the lower panel securing stud bolt 321 inserted into the securing hole (through-hole) H1 punched near each of four corners of the lower panel 210.

In addition, the lower panel 210 may be additionally secured thereto using the lower panel securing portion for center securing 310. That is, the lower panel 210 may be firmly secured to the inner wall 1 of the hull by fastening the securing rod 311 to a screw portion 312*a* of the securing base 312. The securing base 312 may be secured to an upper surface of the lower panel 210 by rivets and the like.

Next, the upper panel 220 is separately stacked on the lower panel 210 in the thickness direction such that the lower panel 210 and the upper panel 220 are arranged to intersect each other, thereby minimizing heat loss from a gap between the lower panel 210 and the upper panel 220 while suppressing deformation thereof caused by a temperature difference therebetween.

Here, securing of the upper panel 220 on the lower panel 210 may be realized by the upper panel securing portion 400. The configuration of the upper panel securing portion 400 is similar to that of the lower panel securing portion for corner securing 320 and detailed description thereof will be omitted.

After completion of the lower panel 210 and the upper panel 220, a secondary membrane 201 and the primary insulation layer 100 are sequentially installed on the upper panel 220.

According to this embodiment, the primary insulation layer 100 may be constituted by a plurality of plywood sheets, as shown in FIG. 12, or may be constituted by a composite of plywood, a heat insulator and a composite material, as shown in FIG. 13, to have a thickness set to 20% to 30% of a thickness of the secondary insulation layer 200. Here, the heat insulator may be at least one selected from the group of glass wool, polyurethane foam (PUF), and glass-reinforced polyurethane foam (R-PUF).

In the membrane type insulation system for cryogenic liquefied gas carrier cargo tank and liquefied gas fuel container according to the present invention, the secondary insulation layer 200 is constituted by a plurality of panels, for example, the lower panel 210 and the upper panel 220 separately stacked in a bilayer structure and arranged to intersect each other, as shown in FIG. 10, thereby minimizing heat loss from the gap between the panels. That is, the membrane type insulation system has an enlarged thermal path, thereby preventing heat loss such as convection.

Further, as shown in FIG. 11, the upper panel 220 is separately stacked on the lower panel 210 in the thickness direction such that the upper panel 220 and the lower panel 210 are arranged to intersect each other, thereby minimizing deformation of the secondary insulation layer by suppressing deformation thereof due to a temperature difference therebetween upon thermal shrinkage.

Although a conventional technique suggests increase in thickness of a single panel for improvement of thermal insulation, such a conventional technique has a limit to increase in thickness of the panel due to a limit to increase in thickness of the panel (limit to foaming height). However, the insulation system according to the present invention employs a multilayer stack of a plurality of panels, thereby overcoming the limit to increase in heat insulation thickness of the panels.

Increase in thickness of the single panel for improvement in thermal insulation can cause thermal shrinkage due to a temperature difference between the upper part and lower part in panels of the secondary insulation layer, in which an upper portion of the secondary insulation layer undergoes more shrinkage than a lower portion thereof and increase in insulation thickness results in increase in thermal shrinkage, thereby generating a gap between the panels. On the other hand, according to the present invention, since the plural panels disposed to intersect each other have a sandwich structure in which the plywood or the composite material on the surface of the panel undergoes less thermal shrinkage than polyurethane foam, the plural panels undergo smaller shrinkage than a single panel, and intersectional arrangement of the upper panel and the lower panel can suppress generation of a gap between the panels while substantially suppressing heat loss by preventing heat loss from the gap between the upper panels from affecting heat loss from a gap between the lower panels of the secondary insulation layer.

In addition, since the upper panel on the lower panel presses the lower panel in a downward direction and suppresses deformation of the lower panel, deformation of the secondary insulation layer can be minimized, thereby significantly reducing stress applied to a secondary membrane due to deformation of the secondary insulation layer.

It will be apparent to those skilled in the art that the present invention is not limited to the embodiments described above and that various modifications, changes, alterations, and equivalent embodiments can be made without departing from the spirit and scope of the present invention.

Therefore, such modifications, changes, alterations, and equivalent embodiments fall within the spirit and scope of claims.

For example, although the primary and secondary insulation layers are illustrated as an insulation panel adjacent to liquefied gas and an insulation layer adjacent to an inner wall of a hull in the above description, this description is arbitrarily provided for convenience of description and the sequence of the primary and secondary insulation layers may be changed in a different way.

Furthermore, it should be understood that spatially relative terms such as "upper" and "lower" are also arbitrarily defined for convenience of description and the term "upper" can be used interchangeably with the term "lower" depending upon a viewing direction and location of a cargo tank.

The invention claimed is:

1. A membrane type insulation system for cryogenic liquefied gas carrier cargo tank and liquefied gas fuel container, the membrane type insulation system comprising:

a primary insulation layer disposed at a liquefied gas side;

a secondary insulation layer disposed on an inner wall of a hull, wherein the secondary insulation layer comprises a plurality of panels separately stacked in a multilayer structure in a thickness direction of the secondary insulation layer such that upper and lower panels are staggered; and a panel securing unit configured to secure an upper panel of the plurality of panels to the inner wall of the hull via a lower panel of the plurality of panels that is provided between the upper panel and the inner wall of the hull.

2. The membrane type insulation system according to claim 1, wherein the panel securing unit comprises:

a lower panel securing portion configured to secure the lower panels of the plurality of panels to the inner wall of the hull; and an upper panel securing portion configured to secure the upper panels of the plurality of panels to the inner wall of the hull.

3. The membrane type insulation system according to claim 2, wherein the lower panel securing portion comprises:

a center-securing lower panel securing portion disposed at a center of the lower panel; and a corner-securing lower panel securing portion disposed near four corners of the lower panel.

4. The membrane type insulation system according to claim 3, wherein the center-securing lower panel securing portion comprises:

a securing rod welded to the inner wall of the hull and disposed to pass through a securing hole formed at the center of the lower panel; and a securing base having a screw portion formed at a lower portion thereof to be coupled to an upper end of the securing rod and provided with upper panel securing stud bolts to be coupled to four corners of the upper panel.

5. The membrane type insulation system according to claim 3, wherein the corner-securing lower panel securing portion comprises:

a lower panel securing stud bolt secured to the inner wall of the hull on which the lower panel is disposed;

a nut fastened to the lower panel securing stud bolt to secure the lower panel to the inner wall of the hull;

a washer spring fitted into the lower panel securing stud bolt and configured to allow resilience regulation depending upon a degree of deformation of the inner wall of the hull;

a compression securing mold fitted into the lower panel securing stud bolt and stacked under the washer spring to prevent local damage to the lower panel; and a reference wedge configured to allow height adjustment thereof depending upon a degree of deformation of the inner wall of the hull.

6. The membrane type insulation system according to claim 4, wherein the upper panel securing portion comprises:

a nut fastened to each of the upper panel securing stud bolts to secure the upper panel to the inner wall of the hull;

a washer spring fitted into each of the upper panel securing stud bolts and configured to allow resilience regulation; and a compression securing mold fitted into each of the upper panel securing stud bolts and stacked under the washer spring to prevent local damage to the upper panel.

7. The membrane type insulation system according to claim 1, wherein the primary insulation layer has a composite structure of plywood, a heat insulator and a composite material to have a thickness set to 20% to 30% of a thickness of the secondary insulation layer, and the secondary insulation layer has a sandwich structure of glass fiber-reinforced polyurethane foam and plywood.

8. The membrane type insulation system according to claim 1, wherein the secondary insulation layer has a structure in which the plurality of panels are separately stacked in the multilayer structure in the thickness direction of the secondary insulation layer such that the upper panels and the lower panels are staggered to minimize heat loss from a gap between the panels while suppressing deformation of the panels due to a temperature difference therebetween.

* * * * *